United States Patent [19]

Gnatchenko et al.

[11] Patent Number: 4,515,045

[45] Date of Patent: May 7, 1985

[54] AUTOMATIC WRENCH FOR SCREWING A PIPE STRING TOGETHER AND APART

[75] Inventors: Viktor V. Gnatchenko; Nikolai P. Makarov, both of Moscow; Albert S. Shaginian, Gomel; Alexei G. Asan-Dzhalalov, Gomel; Anatoly A. Pevnev, Gomel; Valery A. Panteleev, Gomel; Alexandr P. Androsenko, Gomel; Nikolai I. Davidenko, Gomel; Zoya N. Mochalova, Gomel; Leonid N. Palkin, Gomel, all of U.S.S.R.

[73] Assignee: Spetsialnoe Konstruktorskoe Bjuro Seismicheskoi Tekhniki, Gomel, U.S.S.R.

[21] Appl. No.: 468,482

[22] Filed: Feb. 22, 1983

[51] Int. Cl.[3] ..... B25B 23/00

[52] U.S. Cl. ..... 81/429; 81/57.34; 81/409

[58] Field of Search ..... 81/57.34, 57.36, 57.16, 81/57.22, 467, 469, 470, 429; 29/407; 173/5, 12

[56] References Cited

U.S. PATENT DOCUMENTS

| | | | |
|---|---|---|---|
| 3,368,396 | 2/1968 | Van Burkleo et al. | 81/469 |
| 3,545,313 | 12/1970 | Kelley | 81/57.34 |
| 3,745,820 | 7/1973 | Weiner | 81/469 |
| 3,799,099 | 3/1974 | Guier | 81/57.16 |
| 4,023,449 | 5/1977 | Boyadjieff | 81/57.16 |
| 4,176,436 | 12/1979 | McCombs et al. | 81/467 |
| 4,280,380 | 7/1981 | Eshghy | 81/470 |

FOREIGN PATENT DOCUMENTS 629314 9/1978 U.S.S.R. .

*Primary Examiner*—James L. Jones, Jr.

*Attorney, Agent, or Firm*—Fleit, Jacobson, Cohn & Price

[57] ABSTRACT

An automatic wrench comprises a high-torque, a low-torque, and a locking device. The wrench control system includes a torque detector and a rotation angle detector, in response to whose signals passing through an AND gate a control unit delivers a command to end the thread tighening by the rotation actuator of the high-torque device in screwing a pipe string together or to end the initial loosening of the thread with the aid of the same actuator in screwing it apart. The control unit incorporates a unit for monitoring the duration of the command execution, which stops operation of the high-torque device if no signal comes from said AND gate during the time alloted to accomplish the tightening or the initial loosening of the thread.

4 Claims, 12 Drawing Figures

AUTOMATIC WRENCH FOR SCREWING A PIPE STRING TOGETHER AND APART

BACKGROUND OF THE INVENTION

1. Field of the Invention

The present invention relates to the field of drilling, completion, and repair of oil and gas wells and more particularly to wrenches for screwing a drill pipe string together and apart.

2. Description of the Prior Art

The operation of screwing the threaded connections together or apart is the major one in the overall set of operations associated with hoisting a drill pipe string from, or lowering it into, a well, the major one in terms of labor input, time, and complexity of control.

Pipe wrenches extensively employed in the industry comprise as a rule a high-torque device, a low-torque device, and a locking device, each of the devices comprising grippers and an actuator which provides moving the grippers together and apart.

The high-torque device, intended for a final tightening of the thread in screwing a joint together and for an initial loosening of the joint in screwing it apart, comprises in addition a rotation actuator which serves to rotate a pipe with respect to the drill string through an angle constituting a portion of a full revolution.

The low-torque device, intended for a preliminary screwing-in of the pipe and for a final screwing-off of it, comprises a spinning actuator (see, e.g., U.S. Pat. No. 3,545,313, Cl. 81-57, 34, 1970, No. 4,023,449, Cl. 81-57, 1977).

Wrenches of such a construction are dependable and convenient in use, but suffer from an inadequate efficiency in terms of the speed of performing the screwing together/apart operation, which is primarily due to the necessity of employing manual procedures, stemming in particular from different states of the threaded joints. The greatest difficulty in developing constructions of automated pipe wrenches is posed by detecting the end of thread tightening in screwing a joint together and the end of the initial loosening of thread in screwing a joint apart.

In prior attempts to develop automatic wrenches such a detecting has been effected from one of characteristics, such as an axial displacement of the pipe being screwed in or off (see, e.g., USSR Inventor's Certificate No. 629,314, Int. Cl$^2$. E21B, 19/16, 1978).

Because of a very small axial displacement of the pipe during the initial loosening or tightening of the thread (this amount is less than the thread pitch), the detecting or sensing based on this characteristic cannot be accurate even with an ideal state of the threaded joint.

The lack of accuracy in detecting the initial loosening of thread necessitates stopping the operation of the wrench and repeating the operation manually, which cuts down its efficiency. The lack of accuracy in detecting the thread tightening impairs the dependability of the threaded joint and thereby creates a hazard for the attending personnel and may result in a grave failure of the well equipment.

SUMMARY OF THE INVENTION

An object of the invention is to provide a highly efficient and dependable automatic wrench for screwing a drill pipe string together or apart.

An object of the invention is in particular to provide an accurate detecting or sensing of the tightening of thread in screwing a drill pipe string together and of the initial loosening of thread in screwing it apart.

An object of the invention is also to provide a possibility for employing the wrench as a component of an automated plant for effecting lowering and hoisting operations at a well.

Still another object of the invention is to upgrade the quality of a threaded joint.

The above-mentioned and other objects of the invention are attained by the provision of an automatic wrench for screwing together and apart a string of pipes connected by means of threaded collars, comprising a high-torque device, a low-torque device, and a locking device, and also a control system wherein the system of detectors, according to the invention, comprises a torque detector and a rotation angle detector, installed on the high-torque device, and the control unit includes a unit monitoring the duration of the execution of a command and an AND gate which delivers to the unit monitoring the duration a signal of the completion of the pipe rotation by the high-torque device when having received signals from the two said detectors.

Such a wrench control system ensures a high dependability of tightening of a threaded joint regardless of the state of the latter, since the end of the screwing-in operation is determined from two characteristice simultaneously. This excludes both an insufficient tightening caused by a high resistance of the thread and an excessive tightening which may damage the thread. Ultimately, such a control system ensures a trouble-free wrench operation and a safety of the attending personnel. On the other hand, such a system minimizes the operator's monitoring in unscrewing a threaded joint, which raises the wrench operation efficiency.

To make the torque detector simple in construction and reliable in operation, it is advisable that it is a device adapted to control the pressure in the hydraulic system connected with a hydraulic drive to turn the high-torque device.

To provide a possiblity of using the wrench in automated plants for lowering and hoisting operations at a well, where the automatic wrench position and operation are strictly defined in both time and space, it is advantageous that its locking device is provided with a centering means in the form of two semi-cylinders mounted on grippers of the locking device. The bases carrying on one side the low-torque device and on the other side the high-torque and locking devices should be interconnected with the aid of a pivotal arrangement where the horizontal pivot is rigidly attached to one of said bases for an axial displacement with respect to the other said base and the spinning actuator and the spinning clamping means comprise frames, spring-loaded in the axial direction, for a frictional contact with the pipe screwed in or off.

Such a construction of the automatic wrench provides for a self-alignment of the low-torque device on the pipe whose transverse displacement can be restricted by grippers of the automatic plant, and at the same time the threaded end of the pipe being screwed in is centered with respect to the threaded collar, which allows to increase the speed of lowering the pipe when introducing the threaded end thereof into the opening of the collar and thereby to raise the efficiency of the screwing-in operation.

The automatic wrench may be provided with nozzles for feeding a lubricant onto threaded ends of pipes in the course of screwing the string together. It is advantageous that the nozzles are arranged at uniform intervals on the inside of the semi-cylinders of the centering means and rigidly attached to the semi-cylinders, and a passage for feeding the lubricant to the nozzles is made in the centering means. With such a construction of the wrench, lubricant is continuously fed in the course of screwing in the pipe, which permits increasing the speed of its rotation and thereby to raise the efficiency of the operation. Moreover, the lubricant getting into the joint in the course of the screwing-in has no time to get contaminated and to flow down and remains between the thread turns, facilitating the subsequent screwing-off process.

BRIEF DESCRIPTION OF THE DRAWINGS

The invention will now be explained by the description of an embodiment thereof with reference to the accompanying drawings, in which.

DETAILED DESCRIPTION OF THE INVENTION

Figure 1:
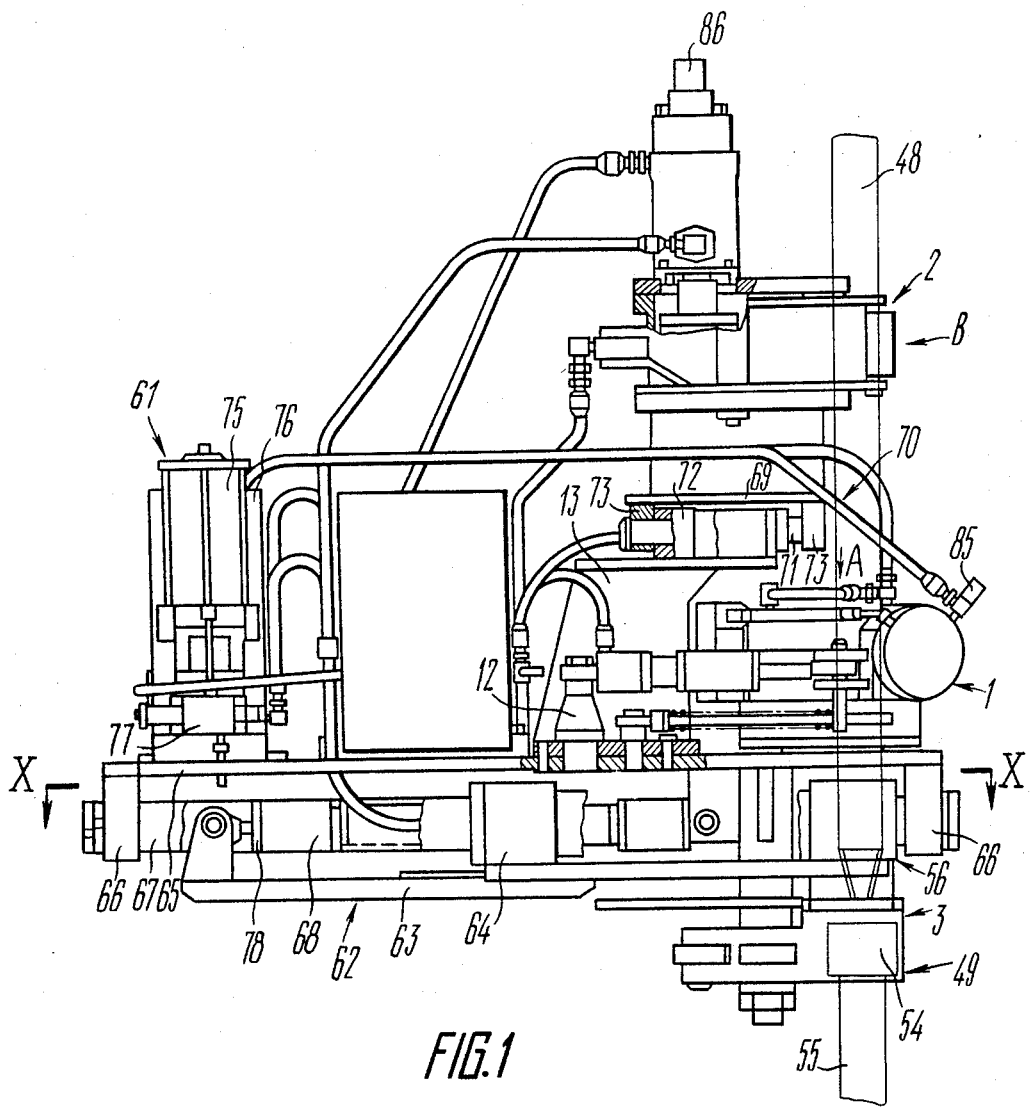
FIG. 1 is a front view of a wrench for screwing a pipe string together and apart, constructed according to the invention.

An automatic wrench for screwing a pipe string together and apart comprises a high-torque device 1 (FIG. 1), a low-torque device 2, and a locking device 3.

The high-torque device 1 comprises a rotating clamping means 4 (FIG. 2) having grippers in the form of three clamping jaws 5 spaced at equal intervals on a circle. The clamping jaws 5 are attached to rods 6 of hydraulic cylinders 7 accommodated in bores in a casing 8 and jointly constituting an actuator for advancing and retracting the grippers.

Figure 2:
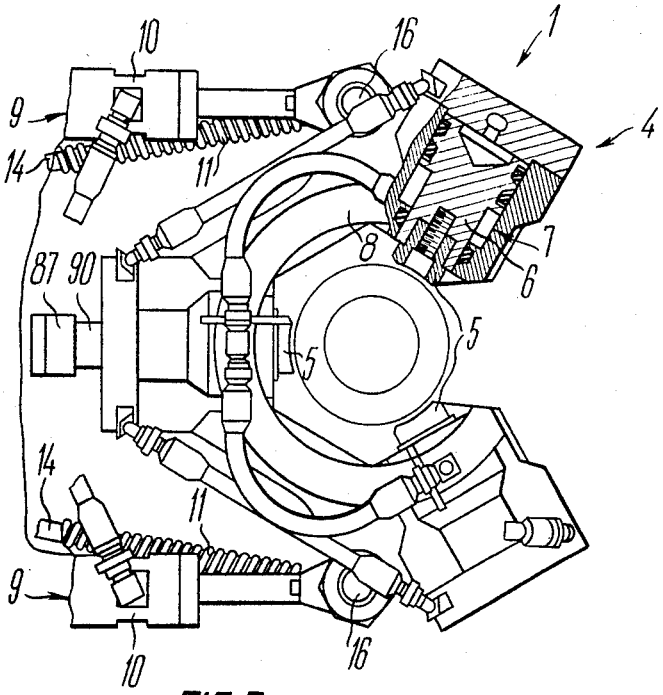
FIG. 2 is a view looking in the direction of the arrow A in FIG. 1, partly broken away at the clamping means of the high-torque device.
Figure 3:
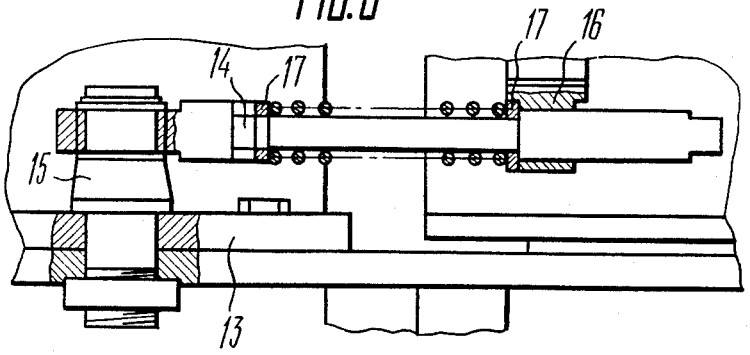
FIG. 3 is an enlarged view, partly broken away, of a portion of the rotation actuator of the high-torque device.

A rotation actuator 9 includes two hydraulic cylinders 10 and two springs 11. The barrels of the hydraulic cylinders 10 are with the aid of posts 12 (FIG. 1) pivotally attached to a first base 13 which is a box-shaped weldment. The rods of the hydraulic cylinders 10 (FIG. 2) are pivotally connected to the casing 8. The springs 11 serve to return the casing 8 to the initial position after its rotation by the hydraulic cylinder 10. The springs 11 are mounted on rods 14 of a composite construction (FIG. 3). One end of each rod 14 is pivotally connected to the base 13 through a post 15 mounted to the base. The other end of the rod 14 is received in a pivot 16 connecting the rod of the hydraulic cylinder 10 with the casing 8. In the initial state, the spring 11 is compressed and arranged between washers 17 which thrust against collars of the rod 14. The washer 17 nearest to the casing 8 protrudes beyond the collar of the rod 14 so that when the relative position of the casing 8 and the base 13 changes, the washer 17 thrusts against the collar of the pivot 16.

The low-torque device 2 (FIG. 1) comprises a spinning clamping means 18 (FIG. 4) having grippers 19, an actuator 20 for moving the grippers together and apart, and a spinning actuator 21.

The spinning actuator 21 comprises a motor 22 (FIG. 5) and a speed reducer 23 whose housing is of a composite construction and includes a lower case 24, a plate 25, an upper case 26, and a cover 27.

Figure 5:
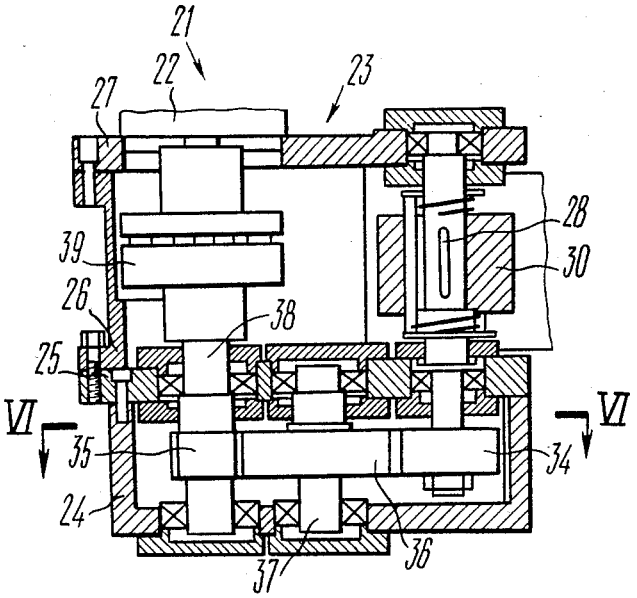
FIG. 5 is a sectional view taken along the line V—V in FIG, 4.
Figure 6:
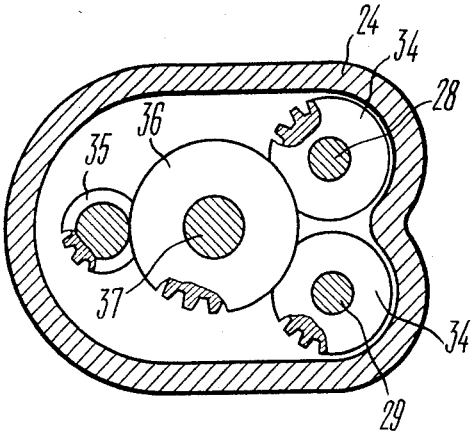
FIG. 6 is a sectional view taken along the line VI—VI in FIG. 5.
Figure 7:
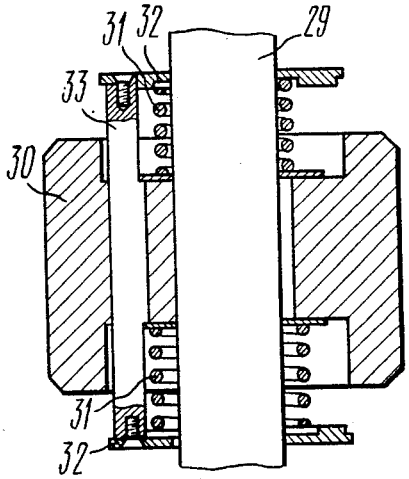
FIG. 7 is an enlarged view of one of driving rollers of the low-torque device.

The upper case 26 houses driving rollers 30 mounted on shafts 28 and 29 (FIG. 6); each of the rollers 30 is loaded at two sides by springs 31 (FIG. 7) thrusting against washers 32 mounted for an axial movement on ends of three posts 33 installed around the shaft 28 or 29 respectively in the body of the rollers 30. The lower portion of each shaft 28 and 29 carries driven gears 34 (FIG. 5) geared to a driving gear 35 through an idler gear 36 (FIG. 6) rigidly attached to a shaft 37 mounted in bearings of the housing of the speed reducer 23 (FIG. 5). The driving gear 35 is integral with the driving shaft 38 mounted in bearings, installed in the lower case 24 and in the plate 25, and extending into the interior of the upper case 26. The top end of the driving shaft 38 is through a coupling 39 coupled to the shaft to the motor 22 mounted on the cover 27 of the speed reducer 23.

Figure 8:
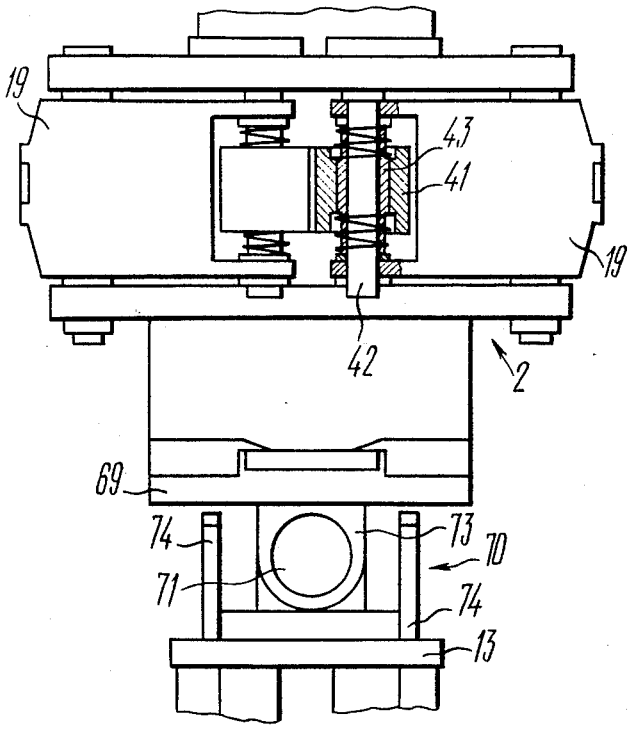
FIG. 8 is a view looking in the direction of the arrow B in FIG. 1, partly broken away at the clamping roller of the low-torque device.
Figure 9:
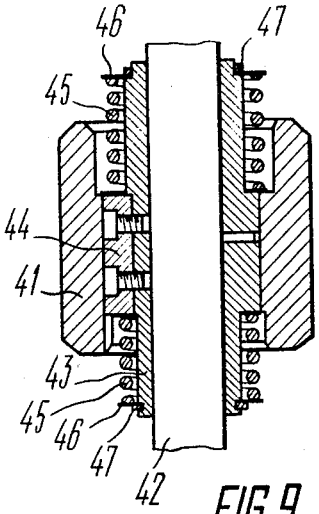
FIG. 9 is an enlarged view of one of clamping rollers of the low-torque device.

The grippers 19 (FIG. 4) of the spinning clamping means 18 are double-arm levers installed for rocking around vertical pivots 40 mounted in the housing of the speed reducer 23. Each of the levers has a working end and a driven end. The driven ends of the grippers 19 are pivotally connected with the rod and barrel of a hydraulic cylinder which is the actuator 20 for moving them together and apart. The fork-shaped end of each gripper 19 (FIG. 8) carries a clamping roller 41 (FIG. 9). The spindle 42 of the roller 41, rigidly coupled to the forked end of the gripper 19, carries a rotatable bushing 43 whose middle, more thick, portion accommodates a key 44 secured to the bushing 43 and received into a key slot in the clamping roller 41. The ends of the bushing 43, extending beyond the roller 41, mount springs 45 thrusting against washers 46 whose movement at the ends of the bushing 43 is restricted by circlips 47. The clamping rollers 41 jointly with the driving rollers 30 are adapted to encompass a pipe 48 (FIG. 1) during the screwing-in and screwing-off operations. Thus the kinematic connection between the rollers 41 of the spinning clamping means 18 and the rollers 30 of the spinning actuator is realized through the pipe 48.

The locking device 3 (FIG. 1) comprises a locking clamping means 49 with grippers 50 and 51 (FIG. 10) having the form of double-arm levers interconnected by a vertical pivot 52. The driven ends of the grippers 50 and 51 are pivotally connected to the rod the barrel of a hydraulic cylinder which is an actuator 52 for moving the grippers together and apart. The working ends of the grippers 50 and 51 have recesses whose size corresponds to the outside diameter of a threaded collar 54 (FIG. 1) which couples in a string 55 the threaded ends of the string pipes.

In the preferred modification of the automatic wrench, the locking device 3 comprises a centering means 56 in the form of semi-cylinders 57 and 58 (FIGS. 10, 11) secured atop the grippers 50 and 51. Each of the semi-cylinders has at its top end a ridge 59 (FIG. 11) whose inside diameter somewhat exceeds the diameter of the pipe 48 so that when the semi-cylinders 57 and 58 are brought together, a clearance allowing a relative movement of the pipe 48 is formed between the pipe 48 and the surface of the ridges 59. Nozzles 60 of a lubrication system 61 (FIG. 1), described in more detail below, are installed in the walls of the semi-cylinders 57 and 58.

The wrench comprises also a transverse movement device 62 (FIG. 1) which includes a baseplate 63 with guide bushings 64 (FIG. 10) and slide 65 (FIG. 1) whose lugs 66 are rigidly attached to guide rods 67 installed in the guide bushings 64 for a movement in the direction transverse with respect to the axis of the pipe string 55 (FIG. 1) being screwed together or apart. The device 62 comprises a transverse movement actuator 68 in the form of a hydraulic cylinder whose barrel is pivotally connected to the baseplate 63, and the rod, to the slide 65.

The locking device 3 is secured on the slide 65 which carries the first base 13 rigidly attached thereto. Thus, the locking device 3, as the high-torque device 1, is rigidly coupled to the first base 13.

The low-torque device 2 is installed on a second base 69 (FIG. 1) interconnected with the first base 13 through a pivotal arrangement 70 comprising a horizontal pivot 71 (FIG. 1, 8) rigidly secured in stands 72 (FIG. 1), connected to the first base 13, and installed for rotation and axial movement in stands 73 secured to the second base 69. The relative displacement of the bases 13 and 69 transversely to the pivot 71 is restricted by side stops 74 (FIG. 8).

The above-mentioned lubrication system 61 (FIG. 1) comprises an oil tank 75 mounted on a bracket 76 installed on the slide 65, an oil pump 77, and oil supply pipes 78. The nozzles 60 (FIG. 11) communicate with the pipes 78 (FIG. 10) through passages 79, 80, and 81 (FIG. 11) and unions 82.

The nozzles 60 (FIG. 10) are equally spaced around the circle of the centering means 56; a line drawn through the axes of the nozzles on the inside of the semi-cylinders 57 and 58 (FIG. 11) is inclined at an angle corresponding to the angle of helix of the thread of the joint being screwed together. The ridges 59 of the semi-cylinders 57 and 58 protect the joint from an ingress of dust.

Figure 12:
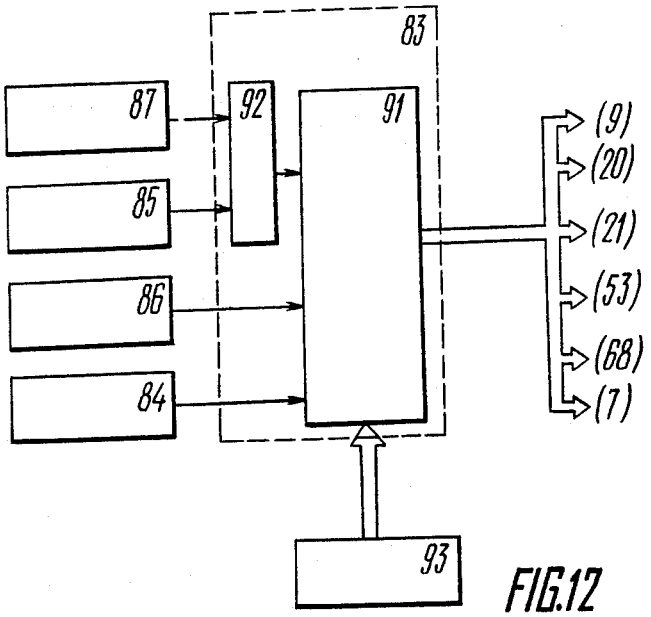
FIG. 12 is a block diagram of the control system of the wrench.

The control system of the automatic wrench includes a control unit 83 (FIG. 12), a system of detectors, and electrically-controlled actuating mechanisms (not shown) which act upon the actuators for moving together and apart the grippers of the high-torque, low torque, and locking devices 1, 2, 3 (FIG. 1), the rotation actuator 9 (FIG. 2), the spinning actuator 21 (FIG. 4), and the transverse movement actuator 68 (FIG. 1), which are hydraulic and connected to a hydraulic system (not shown).

The system of detectors includes:

wrench position detector 84 installed on the slide 65 (FIG. 10) and delivering one of two signals: ADVANCED-RETRACTED, which correspond to the working position of clamping means of the devices of the wrench (when the axes of the apertures defined by their grippers in the brought-together position align with the axis of the pipe string being screwed together or apart);

torque detectors 85 and 86 (FIG. 1) installed respectively in the high-torque device 1 and in the low-torque device 2 of the wrench (FIG. 1) and delivering one of two signals, MAXIMUM or MINIMUM, which correspond to the preset maximum and minimum values of the torque developed by the device in question respectively in screwing the pipe string 55 together or apart;

a rotation angle detector 87 (FIG. 2) installed on the first base 13 and delivering a signal when the angle of rotation on the casing 8 in screwing the string 55 (FIG. 1) together or apart has reached the preset value.

The wrench position detector 84 (FIG. 10) is any conventional contactless transmitter interacting with flags 88 and 89 installed on the baseplate 63. The torge is monitored by changes in pressure in the hydraulic system. Therefore in the preferable modification of the wrench according to the invention the torque detectors 85 and 86 (FIG. 1) are conventional pressure monitoring devices, such as pressure switches or electric-contact pressure gauges.

The detector 87 (FIG. 2) is a conventional contactless transmitter interacting with a flag 90 attached to the casing 8.

The control unit 83 (FIG. 12) comprises a logic programmed control device 91 which generates wrench control commands in the preset sequence. A detailed description of this device is given in our application "Automated plant for lowering and hoisting operations", filed simultaneously with the present application. The device 91 includes a unit for monitoring the duration of the execution of a command, which is a timer.

The control unit 83 comprises also an AND gate 92 which delivers to the device 91 a signal of the completion of the operation of rotation of the pipe 48 (FIG. 1) by the high-torque device 1 in screwing the pipe string 55 together or apart, when signals from the detectors 85 (FIG. 1) and 87 (FIG. 2) are applied to the gate 92.

The unit 83 (FIG. 12) is by its inputs electrically coupled with the detectors 84 through 87 and with an operator's control panel 93. The outputs of the unit 83 are electrically coupled with the electrically-controlled actuating mechanisms which are electrohydraulic valves of the hydraulic system that feeds the actuators of the devices of the wrench, which have the form of hydraulic cylinders or hydraulic motors.

In screwing the pipe string 55 (FIG. 1) together, the above-described wrench functions as follows.

The axis of the pipe 48 is with the aid of a lowering/hoisting device installed at the well aligned with the axis of the string 55 arranged on the axis of the well, after which, under a command from the control unit 83, the actuator 68 of the transverse movement device 62 moves the slide 65, which carries the devices 1, 2, and 3 of the wrench, to the working position. When the slide 65 has come to the working position, the wrench position detector 84 delivers a signal, on receiving which signal the control unit 83 turns off the actuator 68 and turns on the actuator 53 (FIG. 10) to bring together the grippers 50 and 51 of the locking clamping means 49. The string 55 (FIG. 1) gets clamped on the outside of the threaded collar 54 incorporated in the string. The semi-cylinders 57 and 58 of the centering means 56 (FIGS. 10, 11) are as well brought together to locate the pipe 48 accurately on the axis of the string 55 (FIG. 1). The pipe 48 is with the aid of the lowering/hoisting device lowered into the threaded opening of the collar 54 secured on the end being joined of the string 55, after which the control unit 83 delivers a command to the actuator 20 for bringing together the grippers 19 (FIG. 4) and to the spinning actuator 21.

When the grippers 19 are rotated, the clamping rollers 41 mounted on the ends of the grippers press the pipe 48 against the driving rollers 30. As this takes place, the low-torque device 2 (FIG. 1) sets in accordance with the pipe 48, turning round and moving along the horizontal pivot 71.

Figure 4:
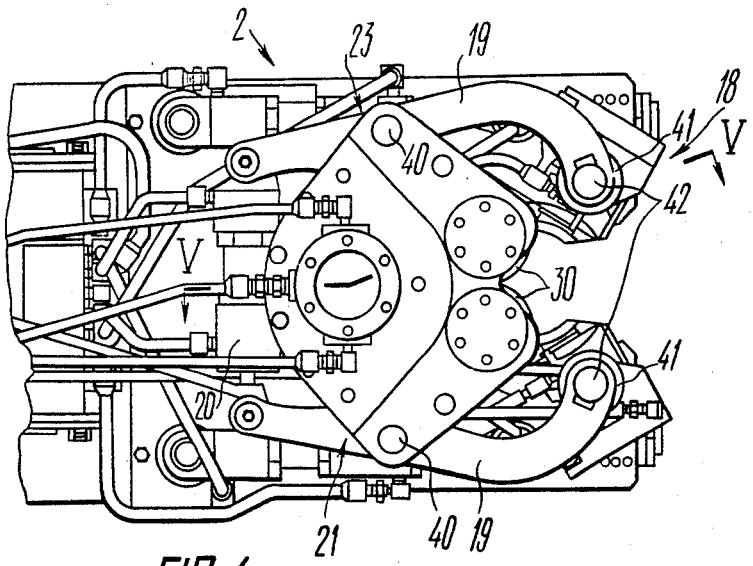
FIG. 4 is a fragmentary plan view of the wrench on a somewhat smaller scale.

Rotation from the motor 22 (FIG. 5) is through gears 35, 36, 34 (FIG. 6) transmitted to the driving rollers 30 (FIGS. 4, 5) which transmit the torque to the pipe 48 (FIG. 1) clamped between the rollers 30 and 41 (FIG. 4).

When being rotated, the pipe 48 (FIG. 1) screws into the thread of the collar 54 and hence moves downwards, entraining the rollers 30 (FIG. 7) and 41 (FIG. 9), which move along the shafts 28, 29 (FIG. 6) and the spindle 42 (FIG. 9), compressing the springs 31 (FIG. 7) and 45 (FIG. 9) disposed under them.

The oil pump 77 (FIG. 1) is turned on simultaneously with the motor 22 (FIG. 5), and oil from the tank 75 (FIG. 1) is fed through the oil supply pipes 78 and the passages 79, 80, and 81 (FIG. 11) to the nozzles 60 disposed in the centering means 56. A high quality of the lubrication of the threaded joint is ensured, apart from the oil supply in a proper time (in the course of operation), also by that oil drops falling down from the thread collect in the annular space defined between the pipe 48 and a groove in the collar 54. The centering ridges 59 minimize the possible ingress of mechanical particles from the environment into the threaded joint.

If the torque developed by the spinning actuator 21 of the low-torque device 2 attains the preset maximum value later than elapses the time period preset by the timer for carrying out the command for screwing-in operation, the unit 83 stops the work of the wrench, and a decision about its further work takes the operator.

Figure 10:
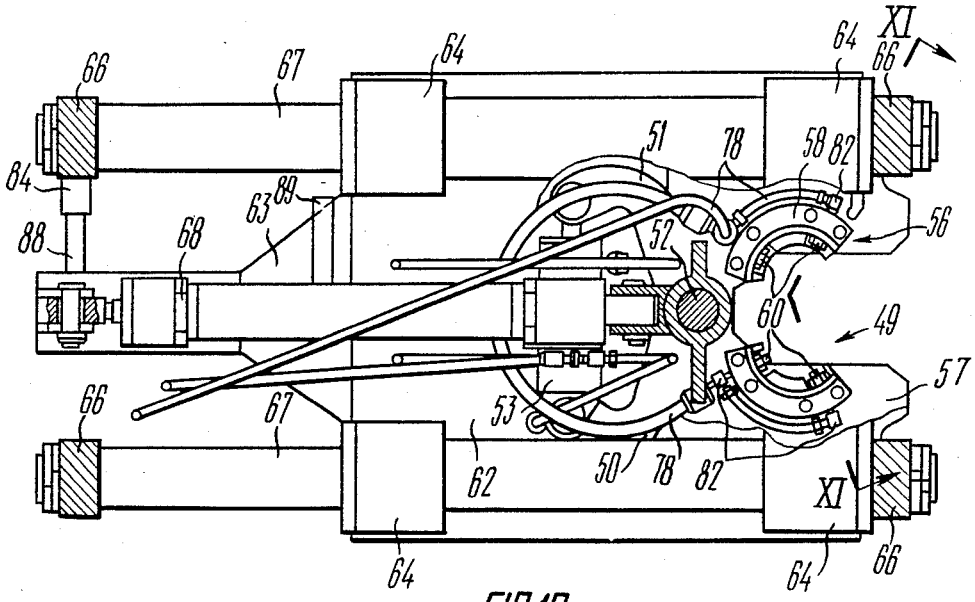
FIG. 10 is a sectional view taken along the line X—X in FIG. 1.
Figure 11:
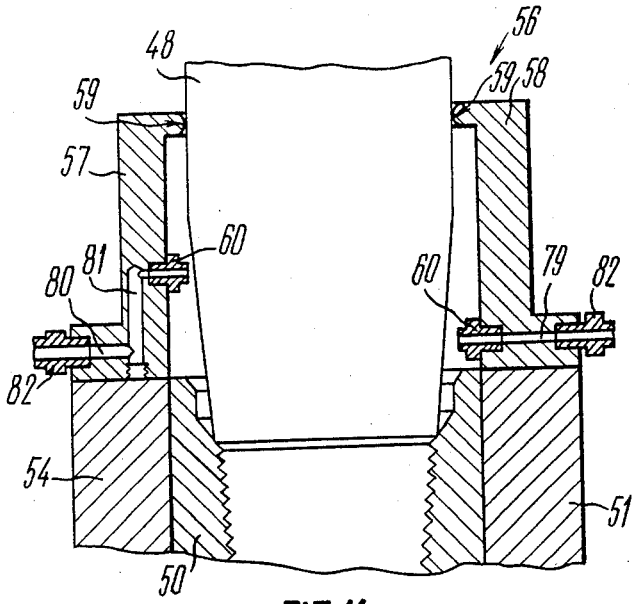
FIG. 11 is a sectional view taken along the line XI—XI in FIG. 10 (the centering means is conventionally closed)

In normal operation of the low-torque device 2, after attaining the preset maximum torque by the actuator 21 in a preset time period, said maximum torque being detected by the detector 86, the control unit 83 (FIG. 12) turns off the spinning actuator 21 of the low-torque device 2 (FIG. 4) and turns on the hydraulic cylinders 7 (FIG. 2) to bring together the clamping jaws 5 of the high-torque device 1. As the required clamping force has been reached, the working fluid is applied to the interior of the hydraulic cylinders 10 of the rotation actuator 9 so that the casing 8, coupled to the hydraulic cylinders through the pivots 16, rotates jointly with the pipe 48 (FIG. 1) clamped in jaws 5 (FIG. 2) clockwise, compressing one of the springs 11 (FIGS. 2 and 3) on the corresponding rod 14. The rotation of the pipe 48 (FIG. 1) and the tightening of the thread of the joint of the pipe 48 with the string 55 proceeds until the AND gate 92 (FIG. 12) receives from the detectors 85 and 87 (FIGS. 1 and 2) the signals indicating that the high-torque device 1 has reached the preset maximum torque (corresponding to the thread tightening torque) and the preset rotation angle (thread tightening angle). In this case the signal from the AND gate 92 (FIG. 12) is applied to the control unit 83. If said signal is applied within the limits of the time period predetermined by the timer, the unit turns off the rotation actuator 9 (FIG. 2). At the same time, the hydraulic cylinders 7 retract the jaws 5 from the screwed-in pipe 48, and the spring 11, which was compressed in the rotation, returns the casing 8 to the initial position. Under a command from the control unit 83 (FIG. 12), the actuators 20 (FIG. 4) and 53 (FIG. 10) move apart the grippers 19 (FIG. 4), 50 and 51 (FIG. 10) of the low-torque and high-torque devices 2 and 3 (FIG. 1), the rollers 30 and 41 (FIG. 4) being returned to the initial position by the lower springs 31 (FIG. 7) and 45 (FIG. 9). Next, the control unit 83 (FIG. 12) delivers a command to the actuator 68 of the transverse movement device 68 (FIG. 1), and the latter retracts the slide 65 to the initial position and turns off in response to the signal from the detector 84 (FIG. 10).

The provision of the detectors 85 and 87 (FIGS. 1 and 2) in the control system of the wrench and their coupling to the unit 83 through the AND gate 92 ensure a reliable joining of pipes. The required tightening torque and angle are in each specific case defined by the thread type and size and are attained by an appropriate setting of the detectors 85 and 87. If the thread is fouled with foreign matter (dust, rust), which will call for increasing the tightening torque, the preset value of the maximum torque will be reached, but the rotation angle will be less than the preset one. In this case only one signal will be applied to the AND gate 92 (FIG. 12), with the result that no signal will appear at the output of the gate, and on the expiration of the preset time for ceasing the work of the wrench. The further operation of the wrench will recommence after the operator has eliminated the causes of the trouble or measures have been taken to provide a manual screwing-in of the pipe.

In screwing off the pipe 48, the wrench operates as follows.

Under a command from the control unit 83 (FIG. 12), the actuator 68 of the transverse movement device 62 (FIG. 1) moves the slide 65 with the devices 1, 2, 3 to the working position, after which, in response to a signal from the wrench position detector 84 (FIG. 10), the unit 83 (FIG. 12) delivers a command to the actuator 53 (FIG. 10) to bring together the grippers 50 and 51 of the locking clamping means 49, which embrace the string 55 (FIG. 1) on the outside of the threaded collar 54. At the operation of screwing off the string 55, the semi-cylinders 57 and 58 of the centering means 56 (FIG. 11) locate the pipe 48 being screwed off so as to prevent a misalignment of its threaded end with respect to the thread in the opening of the collar 54. On the expiration of the time needed for clamping the string 55 by the locking clamping means 49, the unit 83 (FIG. 12) delivers a command to the actuator 20 (FIG. 4), and the pipe 48 (FIG. 1) being screwed off is clamped with rollers 30 and 41 (FIG. 4) as has been described above. As this takes place, the low-torque device 2 (FIG. 1) self-adjusts with respect to the pipe 48. The next command from the unit 83 is delivered to the hydraulic cylinders 7 (FIG. 2) of the high-torque device, and their rods 6 advance the clamping jaws 5 to the body of the pipe 48, following which the working fluid is applied to those interiors of the hydraulic cylinders 10 of the actuator 9, which are opposite with respect to the interiors filled in the operation of screwing in the pipe 48. As a result, the latter is turned counterclockwise and the corresponding one of the springs 11 is compressed. The initial loosening of the pipe 48 by the high-torque device 1 will continue until the torque has reached the preset minimum value and the pipe 48 has rotated through the preset rotation angle. As the two conditions have been met, the detectors 85 (FIG. 1) and 87 (FIG. 2) deliver signals to the AND gate 92 (FIG. 12), on receiving whose output signal (if it is applied within the time period preset by the timer), the control unit 83 delivers a command to stop the rotation. The hydraulic cylinders 7 (FIG. 2) retract the clamping jaws 5, and the hydraulic cylinders 10 of the actuator 9 and the casing 8 return to the initial position under the action of the previously compressed spring 11. The next command from the unit 83 (FIG. 12) turns on the actuator 21 (FIG. 4), and the pipe 48 (FIG. 1) is set in rotation by the low-torque device 2 in the same manner as described above, but in the direction opposite to those in screwing in the pipe. Inasmuch as in the unscrewing the pipe 48 moves translatory upwards, the rollers 30 (FIG. 7) and 41 (FIG. 9) move axially jointly with the pipe, compressing the springs 31 (FIG. 7) and 45 (FIG. 9) disposed above the rollers. The rotation continues till a complete disconnection of the pipes, i.e. till reaching the preset minimum torque, detected by the detector 86 (FIG. 1) which delivers a signal to the unit 83 (FIG. 12), and the latter delivers a command to the actuators 21, 20 (FIG. 4) and 53 (FIG. 10). The motor 22 (FIG. 5) stops; the actuators 20 (FIG. 4) and 53 (FIG. 10) bring apart the grippers 19 (FIG. 4), 50 and 51 (FIG. 10; and the rollers 30 and 41 are returned to the initial position by the upper springs 31 (FIG. 7) and 45 (FIG. 9).

The pipe 48 (FIG. 1) gets hanged on the grippers of the lowering/ hoisting device, brought together beforehand, and a command to withdraw the wrench is applied to the actuator 68 of the device 62. The slide 65 with the devices 1, 2, and 3 is retracted to the initial position, after which the actuator 68 is turned off in response to a signal from the detector 84.

In the event of a jamming of the thread of the connection being unscrewed it may happen that no initial loosening of the pipe 48 from the action of the high-torque device will occur. In this event, no signal from the gate 92 (FIG. 2) will come to the control unit 83, and on the expiration of the time preset for the accomplishment of this operation (the operation duration monitoring unit is turned on simultaneously with the beginning of rotation of the high-torque device 1) the unit 83 will deliver a command to cease the work of the wrench.

In the preferred modification of the control system of the automatic wrench, described in our above-cited application "Automated plant for lowering and hoisting operations", the unit 83 delivers a command to repeat the cycle. After several repeated cycles (the number of the repetitions is set by the program on the control panel 93), the unit 83 stops operation, and the operator makes a decision.

If any case the low-torque device 2 (FIG. 1), in unscrewing operation, will not operate before the required state of the threaded joint is attained, and in screwing-in operation the high-torque device will not turn off before the required parameters of thread tightening. This ensures reliability of the thread joint provided by the wrench.

The above-described automatic wrench for screwing a pipe string together and apart is simple in construction, dependable in operation, highly effective, and ensures a high quality of the threaded joint connection.

While a particular embodiment of the invention has been shown and described, various modifications thereof will be apparent to those skilled in the art. Various modifications may be made in the present invention without departing from the spirit and scope of the invention as defined in the claims.

What is claimed is:

1. An automatic wrench for screwing together and apart a string of pipes joined with threaded collars, said automatic wrench comprising:

a first base;

a high-torque device mounted on said first base and including:

a rotatable clamping means having grippers adapted to embrace a pipe;

an actuator for bringing together and apart the grippers of said rotatable clamping means, operatively connected with said grippers; and a rotation actuator, operatively connected with said rotatable clamping means;

a second base mounted on said first base;

a low-torque device mounted on said second base and including:

a spinning clamping means having grippers adapted to embrace the pipe;

an actuator for bringing together and apart the grippers of said spinning clamping means, operatively connected with said grippers; and a spinning actuator operatively connected with said spinning clamping means;

a locking device mounted on said first base under said high-torque device and comprising:

a locking clamping means having grippers adapted to embrace a pipe string on the external side surface of a threaded collar;

an actuator for bringing together and apart the grippers of said locking clamping means, operatively connected with said grippers; and a means for a movable attachment of said second base on said first base; and a control system comprising:

a system of detectors, including:

a torque detector installed on said high-torque device for delivering a signal when the torque developed by said high-torque device reaches as preset value; and a rotation angle detector installed on said high-torque device for delivering a signal when the angle of rotation of said rotatable clamping means with respect to said locking clamping means reaches a preset value;

a control unit for generating control commands based upon the signals of the detectors of said system of detectors, said control unit comprising a unit monitoring the duration of the execution of a command and an AND gate, and the AND gate, upon receiving the signals from said torque detector and rotation angle detector within a preset time measured by said unit monitoring the duration of the execution of a command, outputs a signal indicative of the end of the rotation of the pipe by said high-torque device; and a system of electrically controlled actuating mechanisms acting upon said actuators of said devices under commands from said control unit.

2. An automatic wrench as defined in claim 1, wherein all said actuators are hydraulic and are incorporated into a hydraulic system, and said torque detector is a device adapted to monitor the pressure in said hydraulic system.

3. An automatic wrench as defined in claim 1, wherein said locking device comprises a centering means in the form of two semi-cylinders mounted on the grippers of said locking device and adapted to embrace the pipe with a clearance and said means for a movable attachment of said second base on said first base is a pivotal arrangement having a horizontal pivot rigidly attached to one of said bases and installed for an axial movement on the other said base.

4. An automatic wrench as defined in claim 2, further comprising nozzles for delivering a lubricant onto threaded ends of pipes in the course of screwing a string together, said nozzles being arranged at uniform intervals on the inside of the semi-cylinders of said centering means and rigidly attached thereto, and said centering means has passages for feeding the lubricant to said nozzles.

* * * * *